US011287098B2

(12) United States Patent
Tessmer et al.

(10) Patent No.: US 11,287,098 B2
(45) Date of Patent: Mar. 29, 2022

(54) HEADLIGHT LENS FOR A VEHICLE HEADLIGHT

(71) Applicant: DOCTER OPTICS SE, Neustadt an der Orla (DE)

(72) Inventors: Manuel Tessmer, Jena (DE); Mohsen Mozaffari-Afshar, Gera (DE); Siemen Kühl, Jena (DE); Wolfram Wintzer, Jena (DE)

(73) Assignee: DOCTER OPTICS SE, Neustadt an der Orla (DE)

( * ) Notice: Subject to any disclaimer, the term of this patent is extended or adjusted under 35 U.S.C. 154(b) by 601 days.

(21) Appl. No.: 16/095,764

(22) PCT Filed: Apr. 24, 2017

(86) PCT No.: PCT/EP2017/000502
§ 371 (c)(1),
(2) Date: Oct. 23, 2018

(87) PCT Pub. No.: WO2017/207079
PCT Pub. Date: Dec. 7, 2017

(65) Prior Publication Data

US 2021/0222848 A1 Jul. 22, 2021

(30) Foreign Application Priority Data

Jun. 2, 2016 (DE) ..... 102016006604.0
Jun. 17, 2016 (DE) ..... 102016007346.2

(51) Int. Cl.
*F21S 41/32* (2018.01)
*F21S 41/153* (2018.01)
(Continued)

(52) U.S. Cl.
CPC ..... *F21S 41/322* (2018.01); *F21S 41/143* (2018.01); *F21S 41/153* (2018.01); *F21S 41/24* (2018.01)

(58) Field of Classification Search
CPC ..... F21S 41/24; F21S 41/143; F21S 41/322
See application file for complete search history.

(56) References Cited

U.S. PATENT DOCUMENTS 5,697,690 A * 12/1997 Okuchi ..... B60Q 1/0011 362/551
8,899,802 B2 * 12/2014 Fedosik ..... F21V 5/00 362/511
(Continued)

FOREIGN PATENT DOCUMENTS

DE 10315131 A1 10/2004
DE 102005009556 A1 9/2005
(Continued)

OTHER PUBLICATIONS

PCT International Search Report and Written Opinion completed by the ISA/EP dated Aug. 4, 2017 and issued in connection with PCT/EP2017/000502.
(Continued)

*Primary Examiner* — Jong-Suk (James) Lee
*Assistant Examiner* — Eric T Eide
(74) *Attorney, Agent, or Firm* — Barnes & Thornburg LLP

(57) ABSTRACT

The invention relates to a headlamp lens for a vehicle headlamp, wherein the headlamp lens comprises a precision-molded body made of a transparent material, wherein the body comprises at least one light tunnel (108) and a light-conducting part (109) with at least one optically active light exit surface (102). The light tunnel (108) comprises at least one light entry surface (101) and merges with a bend (107) in the light-conducting part to depict the sharp bend as a
(Continued)

Figure 1:
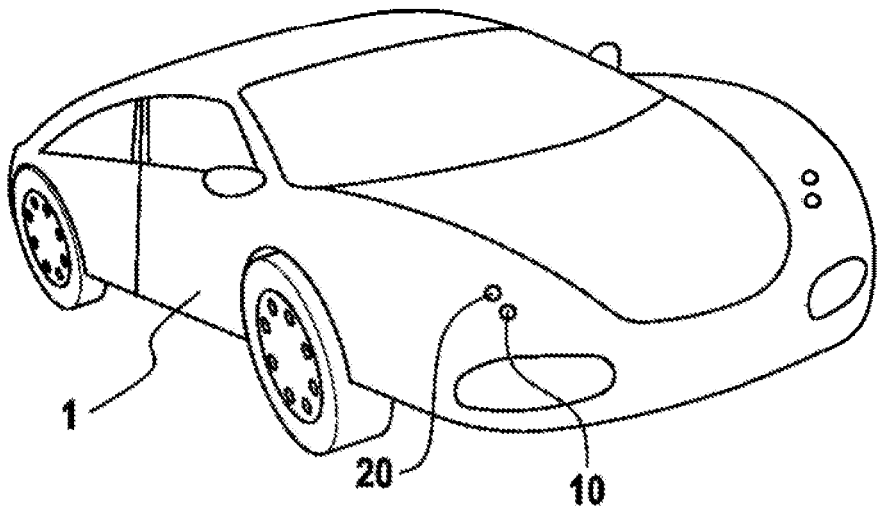

light/dark boundary by means of light coupled or radiated into the light entry surface. The surface of the light tunnel (108) is at least partially convexly curved in the region of the bend (107).

30 Claims, 9 Drawing Sheets

(51) Int. Cl.
*F21S 41/143* (2018.01)
*F21S 41/24* (2018.01)

(56) References Cited

U.S. PATENT DOCUMENTS

| | | | | |
|---|---|---|---|---|
| 2006/0083013 | A1* | 4/2006 | Wanninger | F21S 41/148 362/509 |
| 2007/0279549 | A1* | 12/2007 | Iwasaki | G02F 1/133604 349/64 |
| 2013/0242590 | A1* | 9/2013 | Fedosik | F21S 41/155 362/521 |
| 2015/0300587 | A1* | 10/2015 | Scheibner | B60Q 1/04 362/520 |
| 2015/0330590 | A1* | 11/2015 | Wintzer | F21S 41/265 362/521 |
| 2016/0061398 | A1* | 3/2016 | Lee | F21S 41/322 362/516 |

FOREIGN PATENT DOCUMENTS

| | | | |
|---|---|---|---|
| DE | 102005017528 | A1 | 3/2006 |
| DE | 102004043706 | B4 | 4/2006 |
| DE | 102007016923 | A1 | 10/2008 |
| DE | 102011118270 | A1 | 6/2012 |
| DE | 112010005320 | T5 | 12/2012 |
| DE | 102013001072 | A1 | 7/2014 |
| EP | 1514148 | | 3/2005 |
| EP | 2799924 | A2 | 11/2014 |
| EP | 3124854 | A1 | 2/2017 |
| FR | 3010772 | A1 | 3/2015 |
| WO | 2009109209 | | 9/2009 |
| WO | 2012072188 | | 6/2012 |
| WO | 2012072191 | | 6/2012 |
| WO | 2012072192 | | 6/2012 |
| WO | 2012072193 | | 6/2012 |

OTHER PUBLICATIONS

Official Action issued by the German Patent Office dated Jan. 11, 2017 and issued in connection with German Patent Application No. 102016007346.2.

International Preliminary Report on Patentability issued in connection with PCT/EP2017/000502 and dated Dec. 13, 2018.

* cited by examiner

HEADLIGHT LENS FOR A VEHICLE HEADLIGHT

The invention refers to a headlight lens for a vehicle headlight, in particular for a motor vehicle headlight, wherein the headlight lens includes a monolithic body of transparent material, including at least one light entry face and at least one optically effective light exit face.

WO 2012/072193 A1 discloses a vehicle headlight with a first light source, with at least one second light source and with a first headlight lens assigned to the first light source and comprising a monolithic body of a transparent material, wherein the monolithic body comprises at least one light tunnel and one light passage section with at least one optically effective light exit face, wherein the light tunnel comprises at least one light entry face and passes over, via a bend, into the light passage section for imaging the bend as a bright-dark-boundary by means of light coupled or irradiated into the light entry face of the first headlight lens from the first light source. The vehicle headlight furthermore comprises at least one second headlight lens assigned to the second light source and comprising a monolithic body of a transparent material, wherein the monolithic body comprises at least one light tunnel and one light passage section with at least one optically effective light exit face, wherein the light tunnel comprises at least one light entry face and passes over, via a bend, into the light passage section for imaging the bend as a bright-dark-boundary by means of light coupled or irradiated into the light entry face of the second headlight lens from the first light source.

It is in particular the object of the invention to provide an improved headlight lens for a vehicle headlight, in particular for a motor vehicle headlight. It is in particular desirable to facilitate the manufacture of headlight lenses or the manufacture of motor vehicle headlights.

The aforementioned object is achieved by a headlight lens for a vehicle headlight, in particular for a motor vehicle headlight, wherein the headlight lens includes an in particular press-molded, in particular monolithic body of a transparent material, wherein the in particular monolithic body includes at least one light tunnel and one light passage section having at least one optically effective light exit face, wherein the light tunnel comprises at least one optionally optically effective light entry face and passes over, via a bend, into the light passage section for imaging the bend as a bright-dark-boundary by means of light coupled or irradiated into the light entry face,

- wherein the surface of the light tunnel is at least partially convexly curved in the region of the bend, wherein it is in particular provided for that the convexly curved surface of the light tunnel is a surface of the light tunnel directed downwards, or
- wherein a surface of the light tunnel directed downwards or a portion of the surface of the light tunnel directed downwards is convexly curved.

Here, it is in particular provided for that the curvature extends transverse to the optical axis. The curvature does in particular not extend along the optical axis.

In a furthermore advantageous embodiment of the invention, the convexly curved surface (limiting the light tunnel to the bottom) of the light tunnel is not less curved than a curvature having a radius of curvature of 50 cm. In a furthermore advantageous embodiment of the invention, the convexly curved surface of the light tunnel is not more curved than a curvature having a radius of curvature of 0.3 cm.

In a furthermore advantageous embodiment of the invention, the convexly curved surface of the light tunnel is curved corresponding to a Bézier curve. In a furthermore advantageous embodiment of the invention, the following applies:

$0.3 \cdot d_1 \leq s_1 \leq 0.7 \cdot d_1$ and/or $0.5\ \text{mm} \geq s_2 \geq 6\ \text{mm}$ and/or $10\ \text{mm} \leq d_1 \leq 30\ \text{mm}$ and/or $3\ \text{mm} \leq d_2 \leq 3\ \text{mm}$ and/or $0.3\ \text{mm} \leq d_2 \leq 0.3\ \text{mm}$ and/or $0.4 \leq g \leq 0.6$, if

- the starting point of the Bézier curve has the coordinates 0.0,
- the first coordinate extends (essentially) horizontally (when used according to its purpose), and (essentially) orthogonally to the optical axis of the headlight lens, to the optical axis of the light tunnel, and/or to the optical axis of the light exit face,
- the second coordinate extends essentially vertically (when used according to its purpose), and (essentially) orthogonally to the first coordinate,
- the end point of the Bézier curve has the coordinates $d_1, d_2$,
- the or one control point of the Bézier curve has the coordinates $s_1, s_2$, and
- the or one control point of the Bézier curve has the weighting g.

The light exit face optionally has a cylindrical area or is cylindrical. It is in particular provided for that the light exit face is not rotationally symmetric. It is furthermore in particular provided for that the light exit face extends, in the horizontal direction, by more than 1.5 times its extension in the vertical direction. The light exit face optionally possesses an astigmatism in the x-direction defined below, or in the direction of the x-coordinate defined below, or in the horizontal direction.

It may be provided for that the light exit face is (essentially) defined by a function (distance function, distance function from the y-coordinate/y-axis, parametrising function)

$$r(\Phi, y) = f(\Phi) - \frac{f(\Phi)(n-1)n - \sqrt{n^2(n-1)(f(\Phi)^2(n-1) - (n+1)y^2)}}{n^2 - 1}$$

(or is limited by this function with its parameter variations), wherein 1 is an angle (starting from a z-coordinate) or a polar coordinate (starting from a z-coordinate (I)=0 in the z-direction)) in a plane defined by a/the z-coordinate and an x-coordinate, wherein

- z is a coordinate in the direction of one or the optical axis of the light tunnel and/or in the longitudinal direction of the light tunnel and/or headlight lens and/or the light passage section and/or a segment of the light exit face and/or the light exit face,
- y is a coordinate in the vertical direction and/or an axis of rotation,
- and x is a coordinate orthogonal to the y-direction and orthogonal to the z-direction and/or in the horizontal direction, wherein n is the index of refraction or the refractive index of the transparent material, and wherein $f(\Phi)$ is equal to $r(\Phi, y=0)$ with wherein $\Phi_0$ is equal to 0, and wherein 55 mm≤N≤65 mm and/or 0≤m≤0.3 and/or 1.0≤X≤4.0 and/or 1.0<X≤4.0 and/or 1.1≤X≤4.0 and/or 1.2≤X≤4.0 and/or 1.5≤X≤4.0 and/or

−1≤Y≤1.

It may be provided for that the optically effective light exit face comprises in particular at least two, in particular at least three, in particular three, in particular not more than five segments, wherein at least one segment (in particular a segment not being a central segment, and/or in particular a segment through which the optical axis of the light passage section or the headlight lens does not extend, and/or in particular a segment through which the z-axis or the z-direction does not extend, and/or in particular a marginal segment and/or in particular a non-centred segment, in particular a non-central segment) of the optically effective light exit face is (essentially) defined by a function (distance function, distance function from the y-coordinate/y-axis, parametrising function)

$$r(\Phi, y) = f(\Phi) - \frac{f(\Phi)(n-1)n - \sqrt{n^2(n-1)(f(\Phi)^2(n-1) - (n+1)y^2)}}{n^2 - 1}$$

(or is limited by this function with its parameter variations), wherein Φ is an angle (starting from a z-coordinate) or a polar coordinate (starting from a z-coordinate (Φ=0 in the z-direction)) in a plane defined by a/the z-coordinate and an x-coordinate, wherein n is the index of refraction or the refractive index of the transparent material, and wherein f(Φ) is equal to r(Φ,y=0) with wherein $\psi_0$ is a point of intersection of two segments of the optically effective light exit face at y=0, and wherein 55 mm≤N≤65 mm and/or 0.2≤m≤0.3 and/or 1.0≤X≤4.0 and/or 1.0<≤X≤4.0 and/or 1.1≤X≤4.0 and/or 1.2≤X≤4.0 and/or 1.5≤X≤4.0 and/or 0<Y≤1 and/or 0.1≤Y≤1.

The other side of the light exit face, that means the side for which Φ is negative, is to be designed with a correspondingly adapted mathematical sign.

In an advantageous embodiment of the invention, one or the right side face of the light tunnel and/or one or the left side face of the light tunnel is (at least partially) concavely curved. In a furthermore advantageous embodiment of the invention, one or the right and/or one or the left side face of the light tunnel is (at least partially) curved corresponding to a Bézier curve. In a further advantageous embodiment of the invention, the following applies:

$0.3 \cdot d_1 \leq s_1 \leq 0.7 \cdot d_1$ and/or $0.4 \cdot d_2 \leq s_2 \leq 1.5 \cdot d_2$ and/or $1.5 \leq d_1/d_2 \leq 10$ and/or 0.3≤g≤0.7, if the starting point of the Bézier curve has the coordinates 0.0, the first coordinate extends (essentially) horizontally (when used according to its purpose) and (essentially) along or in parallel to the optical axis of the headlight lens, to the optical axis of the light tunnel, and/or to the optical axis of the light exit face, the second coordinate extends essentially horizontally (when used according to its purpose) and (essentially) orthogonally to the first coordinate, the end point of the Bézier curve has the coordinates $d_1,d_2$, the or one control point of the Bézier curve has the coordinates $s_1,s_2$, and/or the or one control point of the Bézier curve has the weighting g.

In an alternative embodiment, one or the right side face of the light tunnel and/or one or the left side face of the light tunnel is strictly concavely curved in the direction of a coordinate line. This coordinate line is in one embodiment the curve that results if the side face intersects a horizontal plane and/or a plane including the optical axis of the headlight lens, and/or the x-z-plane. This curve will be designated with Γ below. It is here in particular provided for that the radius of curvature of Γ is not smaller than 20 mm and/or not larger than 200 mm. It is in particular provided for that the overall arc length Γ is not shorter than 10 mm and/or not longer than 40 mm. In a further advantageous embodiment of the invention, Γ starts at the edge of the light entry face with a starting direction that is inclined with respect to the optical axis of the headlight lens (within the horizontal plane and/or within the plane including the optical axis of the headlight lens and/or within the x-z-plane) by an angle that is larger than 0 and/or not larger than 15°.

One side face of a light tunnel in the sense of the invention is in particular a surface laterally limiting the light tunnel.

In a further advantageous embodiment of the invention, the light tunnel is funnel-shaped, tapering towards the light entry face. In a further advantageous embodiment of the invention, the right and left side faces of the light tunnel form part of a funnel tapering towards the light entry face. In one embodiment of the invention, the left side face of the light tunnel is not symmetric to the right side face of the light tunnel. In one embodiment of the invention, the left side face of the light tunnel is inclined with respect to the optical axis of the light tunnel. In one embodiment of the invention, the right side face of the light tunnel is inclined with respect to the optical axis of the light tunnel.

An optically effective light entry face or an optically effective light exit face is an optically effective surface of the monolithic body. An optically effective surface in the sense of the invention is in particular a surface of the transparent body where refraction of light occurs when the headlight lens is used according to its purpose. An optically effective surface in the sense of the invention is in particular a surface where the direction of light passing through this surface is (purposefully) changed when the headlight lens is used according to its purpose.

A transparent material in the sense of the invention is in particular glass. A transparent material in the sense of the invention is in particular inorganic glass. A transparent material in the sense of the invention is in particular silicate glass. A transparent material in the sense of the invention is in particular glass as it is described in PCT/EP2008/010136. Glass in the sense of the invention in particular comprises:

0.2 to 2 weight percent of $Al_2O_3$, 0.1 to 1 weight percent of $Li_2O$, 0.3, in particular 0.4 to 1.5 weight percent of $Sb_2O_3$, 60 to 75 weight percent of $SiO_2$, 3 to 12 weight percent of $Na_2O$, 3 to 12 weight percent of $K_2O$, and 3 to 12 weight percent of CaO.

Press-molded in particular means, in the sense of the invention, to press an optically effective surface in such a way that a subsequent finishing of the contour of this optically effective surface may be omitted or is omitted or not provided for at all. It is thus in particular provided for that a press-molded surface is not polished after press-molding.

A light tunnel in the sense of the invention is in particular characterized in that total reflection essentially takes place at its lateral (in particular top, bottom, right and/or left) surfaces, so that light entering through the light entry face is guided through the tunnel as a light guide. A light tunnel in the sense of the invention is in particular a light guide. It is in particular provided for that total reflection occurs at the surfaces at the long sides of the light tunnel. It is in particular provided for that the surfaces at the long sides of the light tunnel are provided for total reflection. It is in particular provided for that total reflection occurs at the surfaces of the light tunnel essentially oriented in the direction of the optical axis of the light tunnel. It is in particular provided for that the surfaces of the light tunnel essentially oriented in the direction of the optical axis of the light tunnel are provided for total reflection. In an advantageous embodiment, it is provided for that the light tunnel has no reflective coating, in particular in the region of the bend.

A bend in the sense of the invention is in particular a curved transition. A bend in the sense of the invention is in particular a transition curved with a radius of curvature of not less than 50 nm. It is in particular provided for that the surface of the headlight lens does not comprise any discontinuity in the bend, but a curvature. It is in particular provided for that the surface of the headlight lens comprises, in the bend, a curvature in particular having a radius of curvature in the bend of not less than 50 nm. In an advantageous embodiment, the radius of curvature is not larger than 5 mm. In an advantageous embodiment, the radius of curvature is not larger than 0.25 mm, in particular not larger than 0.15 mm, advantageously not larger than 0.1 mm. In a further advantageous embodiment of the invention, the radius of curvature in the bend is at least 0.05 mm. It is in particular provided for that the surface of the headlight lens is press-molded in the region of the bend.

In one embodiment of the invention, the orthogonal of the light entry face is inclined with respect to the optical axis of the light passage section, in particular at an angle between 85° and 20°, for example at an angle between 70° and 40°.

In a further advantageous embodiment of the invention, the length of the headlight lens is, in the orientation of the optical axis of the light tunnel and/or the light passage section, not more than 9 cm.

It may be provided for that a light entry face in the sense of the invention and/or a light exit face in the sense of the invention comprises a light scattering structure. A light scattering structure in the sense of the invention may be e.g. a structure as it is disclosed in DE 10 2005 009 556 A1 and EP 1 514 148 A1 or EP 1 514 148 B1. It may be provided for that a light tunnel in the sense of the invention is coated. It may be provided for that a light tunnel in the sense of the invention is coated with a reflective layer. It may be provided for that a light tunnel in the sense of the invention is mirrored.

The above mentioned object is moreover achieved by a vehicle headlight, in particular a motor vehicle headlight, wherein the vehicle headlight comprises a headlight lens—in particular including one or several ones of the above mentioned features—as well as a light source for coupling light into the light entry face. In an advantageous embodiment of the invention, the light source comprises at least one LED or an arrangement of LEDs. In an advantageous embodiment of the invention, the light source comprises at least one OLED or an arrangement of OLEDs. The light source may also be, for example, an extended illuminated field. The light source may also comprise light element chips as disclosed in DE 103 15 131 A1. A light source may also be a laser. A laser that can be used is disclosed in ISAL 2011 Proceedings, pages 271 pp.

It may be provided for that the motor vehicle headlight implements, in connection with at least one further ("further" is, in this paragraph, a synonym for "second" or "at least second") motor vehicle headlight, a low beam. In this case, the further motor vehicle headlight comprises a further headlight lens with a further, in particular press-molded, in particular monolithic body of a transparent material, wherein the in particular monolithic body comprises at least one further light tunnel and one further light passage section with at least one further optically effective light exit face, wherein the further light tunnel comprises at least one, optionally optically effective, further light entry face and passes over, with a further bend, into the further light passage section for imaging the further bend as a bright-dark-boundary by means of light coupled or irradiated into the further light entry face. The further motor vehicle headlight moreover comprises a further light source, in particular an LED, for coupling or irradiating light into the further light entry face.

In a furthermore advantageous embodiment of the invention, the vehicle headlight comprises no secondary optical system assigned to the headlight lens. A secondary optical system in the sense of the invention is in particular an optical system for orienting light exiting from the light exit face or the last light exit face of the headlight lens. A secondary optical system in the sense of the invention is in particular an optical element for orienting light which is separate from the headlight lens and/or disposed downstream thereof. A secondary optical system in the sense of the invention is in particular no covering or protecting disk, but an optical element provided for orienting light. One example of a secondary optical system is, for example, a secondary lens as it is disclosed in DE 10 2004 043 706 A1.

In a further advantageous embodiment of the invention, the distance of the light source from the center of the light exit face in the orientation of the optical axis of the light tunnel and/or the light passage section is not more than 12 cm. In a further advantageous embodiment of the invention, the length of the vehicle headlight (restricted to the light source and the headlight lens) in the orientation of the optical axis of the light tunnel and/or the light passage section is not more than 12 cm.

One or several further light sources of which the light is coupled or irradiated into the passage section and/or a portion of the light tunnel for implementing sign light, high beam and/or corner light may be provided. When such additional light is coupled into the light tunnel, it is in particular provided for that this is done in the half of the light tunnel that is closer to the light passage section and/or in which the light entry face is not provided.

One or several further light sources of which the light is coupled or irradiated into the passage section and/or a portion of the light tunnel for implementing sign light, high beam and/or corner light may be provided. When such additional light is coupled into the light tunnel, it is in particular provided for that this is done in the half of the light tunnel that is closer to the light passage section and/or in which the light entry face is not provided. In particular, additional light source arrangements as described or claimed in WO 2012/072192 A1 may be provided. Additional light source arrangements are in particular described in FIGS. 10, 14, 15, 18, 19, 20 and 21 of WO 2012/072192 A1. The headlight lens according to the invention may in particular also be used in arrays with optical axes that are inclined with respect to each other, as is disclosed (or claimed), for example, in WO 2012/072193 A2, in particular in FIG. 24 of WO 2012/072193 A2. In addition or as an alternative, it may be provided that the headlight lens according to the invention is employed in vehicle configurations as disclosed or claimed in WO 2012/072191 A2.

In a furthermore advantageous embodiment of the invention, the light source and the (first) light entry face are designed and arranged with respect to each other in such a way that light of the light source enters the light entry face with a luminous flux density of at least 75 $lm/mm^2$.

In a furthermore advantageous embodiment of the invention, the light tunnel comprises a region on its surface limiting the light tunnel to the top (when the headlight lens or the vehicle headlight are used according to its purpose) which essentially corresponds to a part of the surface of an ellipsoid, wherein the ellipsoid comprises a first focal point and a second focal point, wherein the light entry face advantageously extends or is oriented

- (essentially) vertically and/or
- (essentially) orthogonally to the optical axis of the headlight lens
- (essentially) orthogonally to the optical axis of the light tunnel
- (essentially) orthogonally to the longitudinal axis of the light tunnel
- (essentially) orthogonally to the optical axis of the light passage section
- (essentially) orthogonally to the optical axis of the light exit face and wherein the light source is (completely) arranged (in the light path) between the first focal point and the second focal point. In a furthermore advantageous embodiment of the invention, the distance of the light source from the first focal point is $\tau \cdot d$ (in a direction of a/the orthogonal of the light entry face and/or in the direction of a straight line through the first focal point and the second focal point), wherein d is the distance of the first focal point from the second focal point, and wherein $\tau$ is greater 0 and smaller than or equal to 0.1. In a furthermore advantageous embodiment of the invention, $\tau$ is greater than or equal to 0.025 and smaller than or equal to 0.1. In a furthermore advantageous embodiment of the invention, $\tau$ is greater than or equal to 0.05 and smaller than or equal to 0.1.

The aforementioned object is achieved by a vehicle headlight—comprising one or several ones of the aforementioned features —, in particular a motor vehicle headlight, with a light source and a headlight lens, wherein the headlight lens comprises an in particular press-molded, in particular monolithic body of a transparent material, wherein the in particular monolithic body comprises at least one light tunnel and one light passage section with at least one optically effective light exit face, wherein the light tunnel comprises at least one optionally optically effective light entry face and passes over, via a bend, into the light passage section for imaging the bend as a bright-dark-boundary by light coupled or irradiated into the light entry face by means of the light source, wherein the light tunnel comprises a region on its surface limiting the light tunnel to the top (when the headlight lens or the vehicle headlight is used according to its purpose) which essentially corresponds to a portion of the surface of an ellipsoid, wherein the ellipsoid comprises a first focal point and a second focal point, wherein the light entry face extends or is oriented

- (essentially) vertically and/or
- (essentially) orthogonally to the optical axis of the headlight lens
- (essentially) orthogonally to the optical axis of the light tunnel
- (essentially) orthogonally to the longitudinal axis of the light tunnel
- (essentially) orthogonally to the optical axis of the light passage section
- (essentially) orthogonally to the optical axis of the light exit face and wherein the light source is (completely) arranged (in the light path) between the first focal point and the second focal point.

A motor vehicle in the sense of the invention is in particular a land craft to be individually used in road traffic. Motor vehicles in the sense of the invention are in particular not restricted to land crafts with an internal combustion engine.

Figure 2:
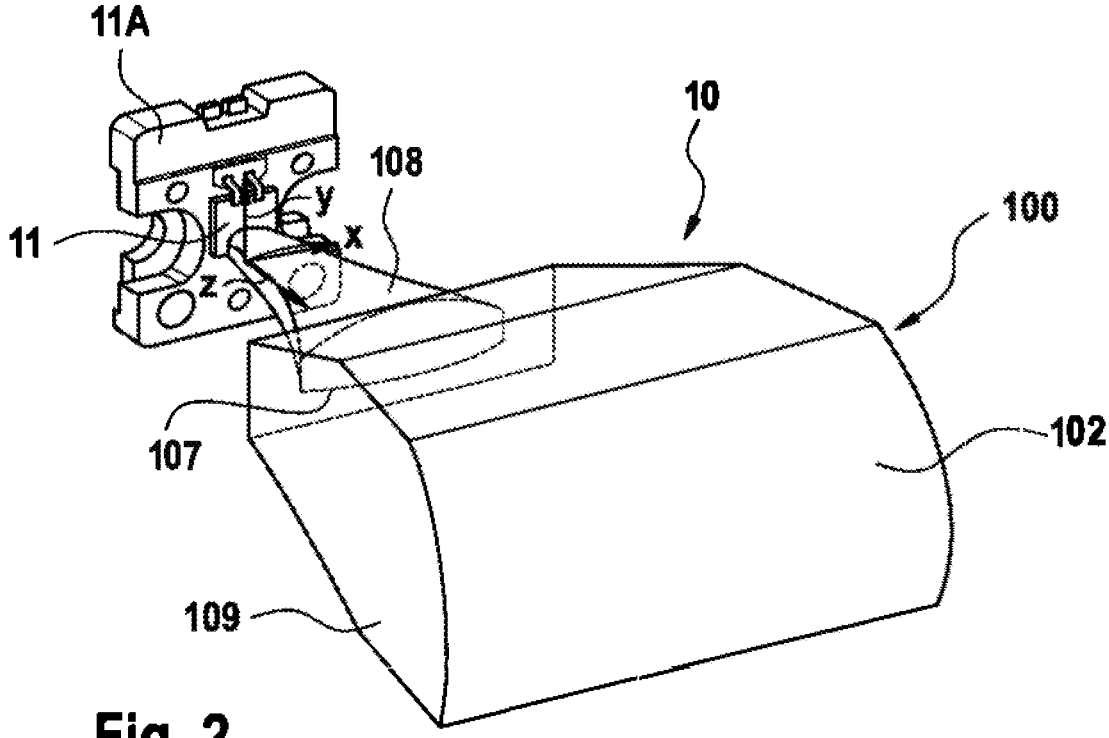
Figure 3:
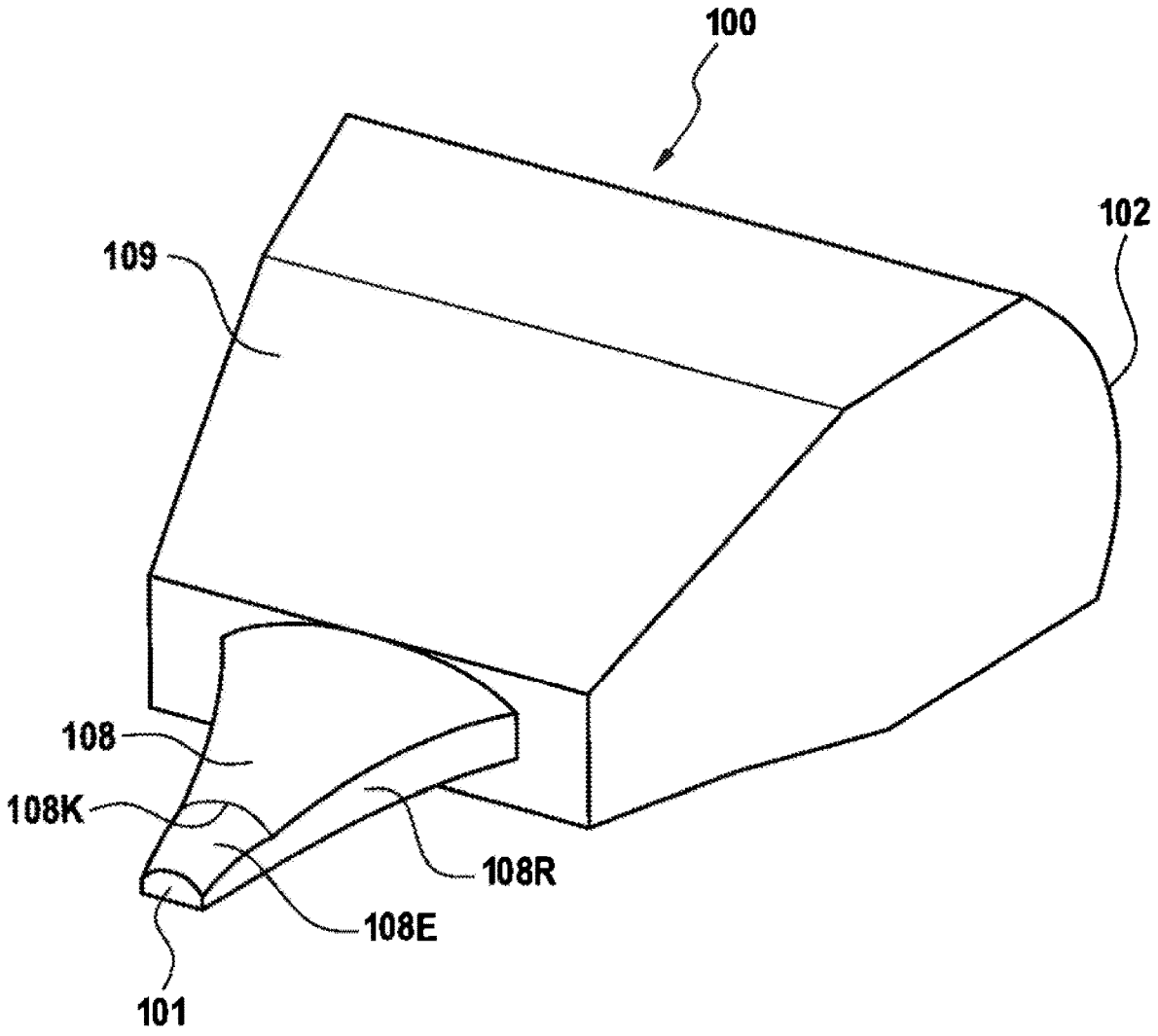
Figure 4:
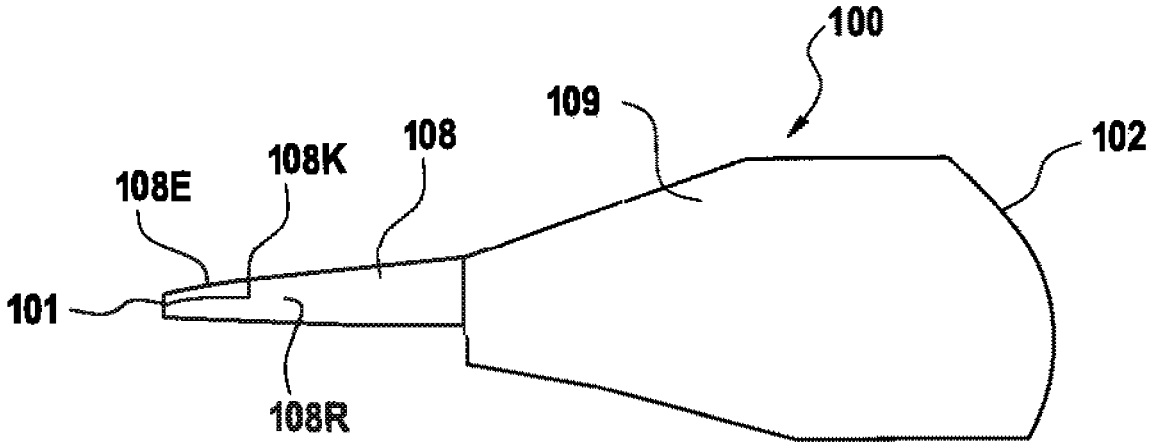
Figure 5:
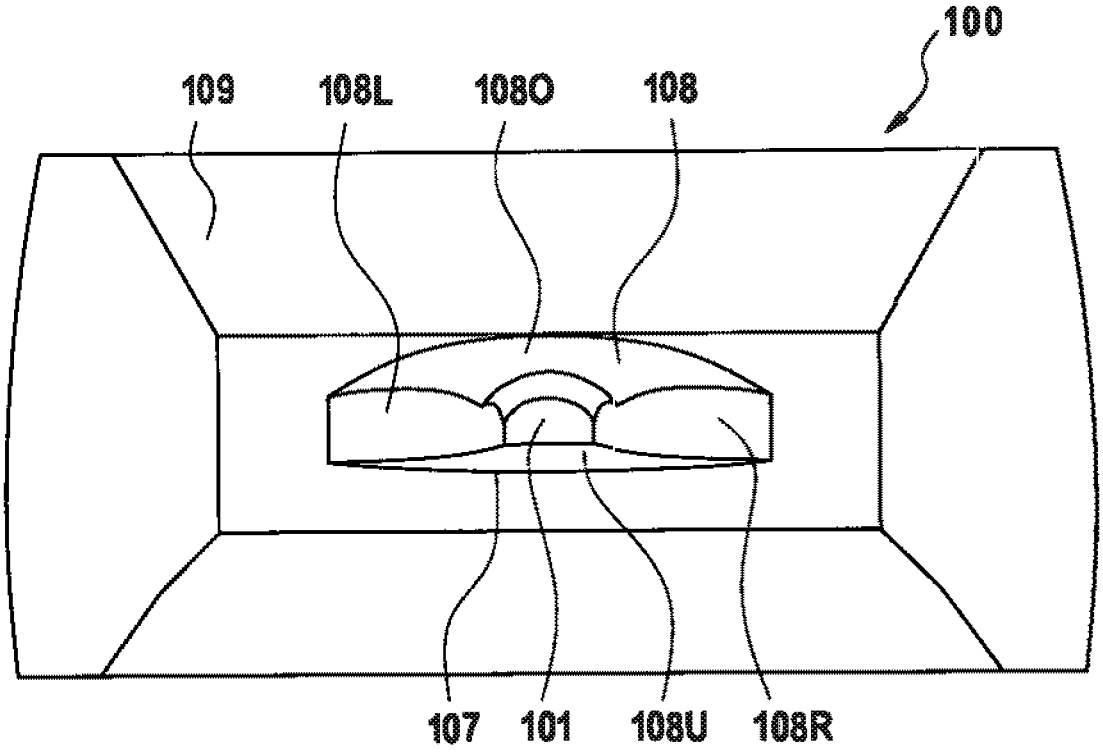
Figure 6:
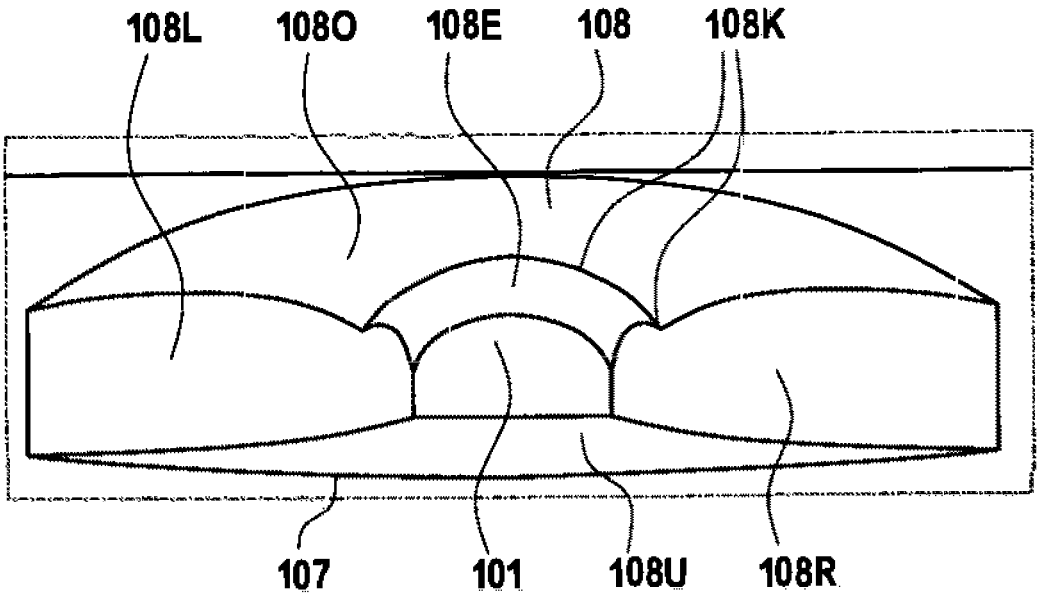
Figure 7:
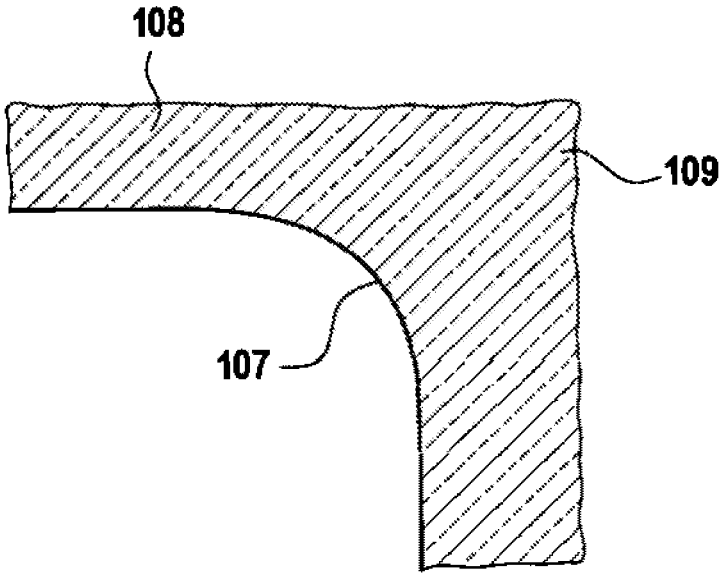
Figure 8:
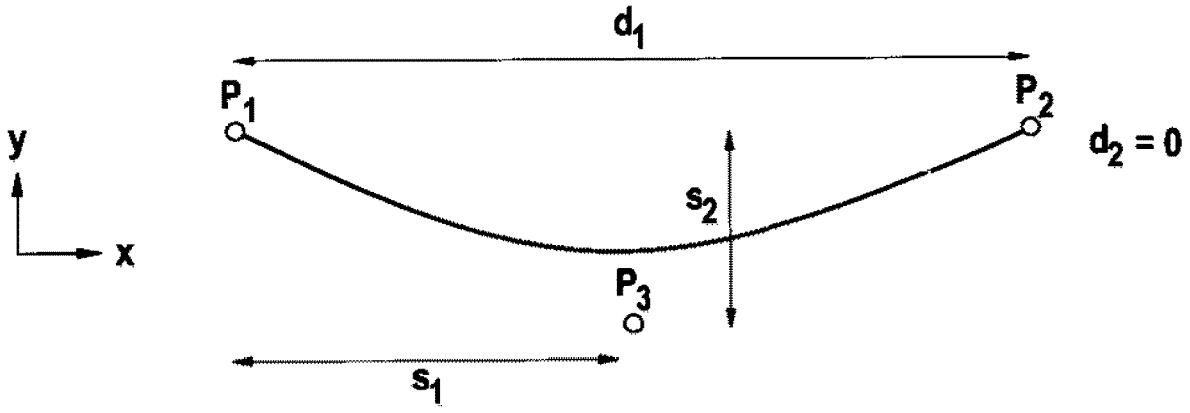
Figure 9:
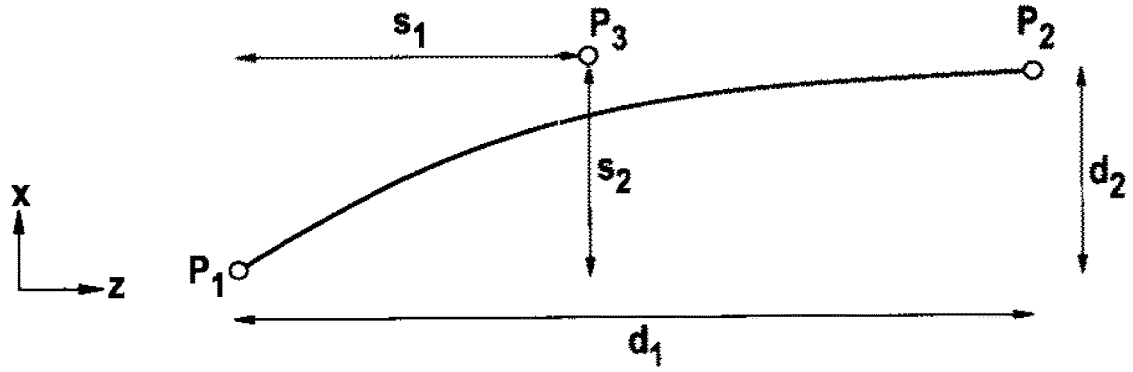
Figure 10:
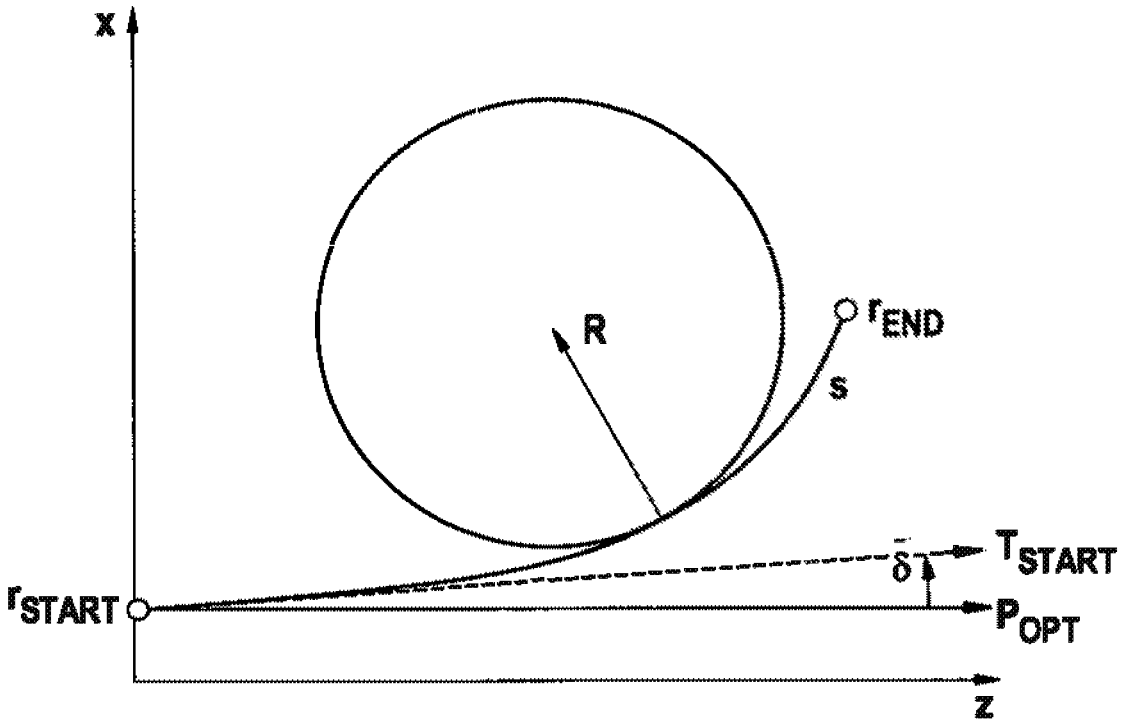
Figure 11:
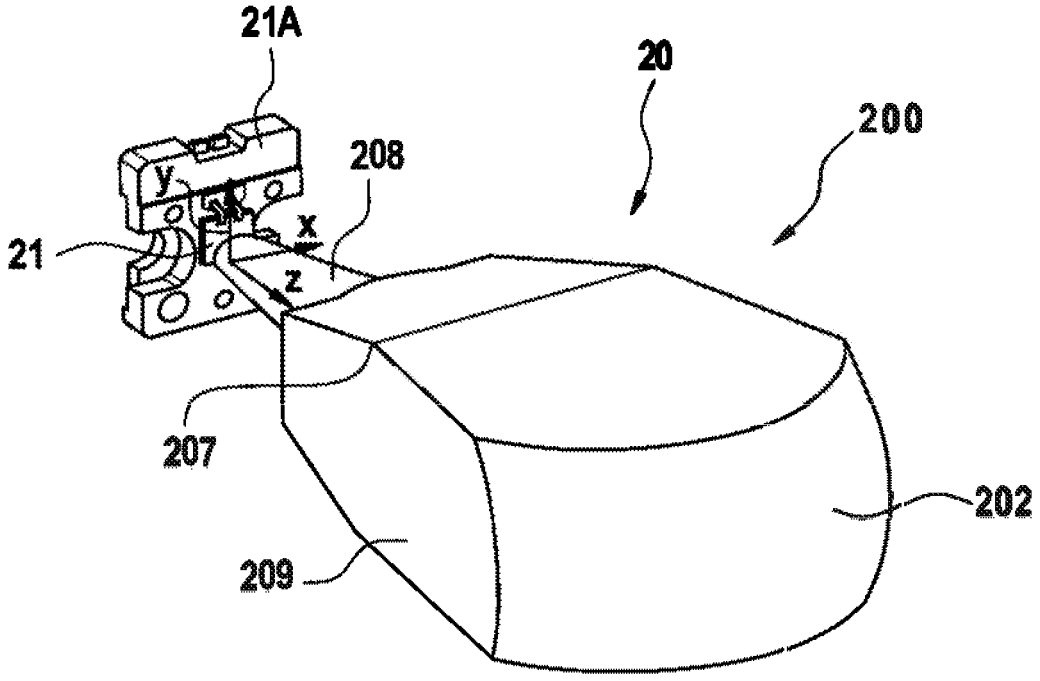
Figure 12:
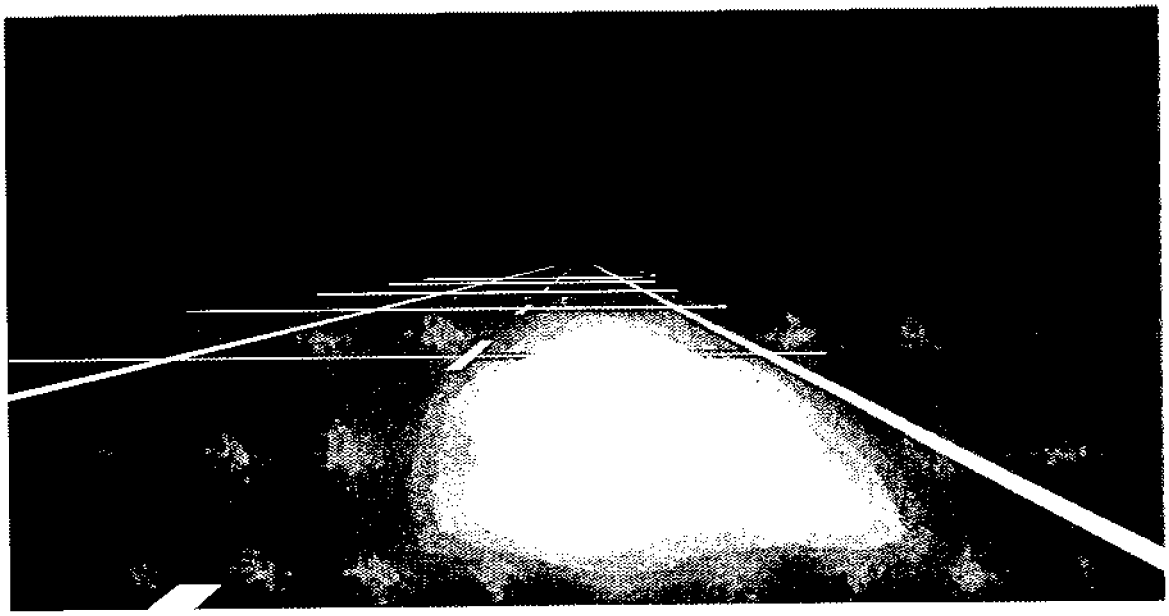
Figure 13:
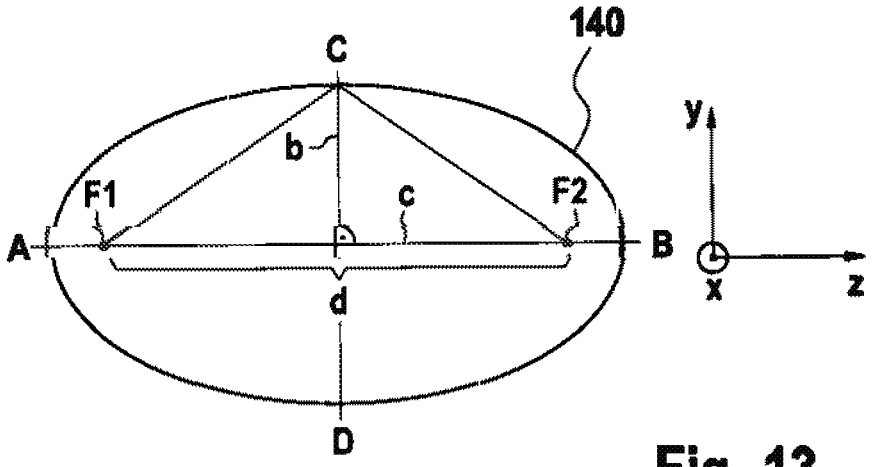
Figure 14:
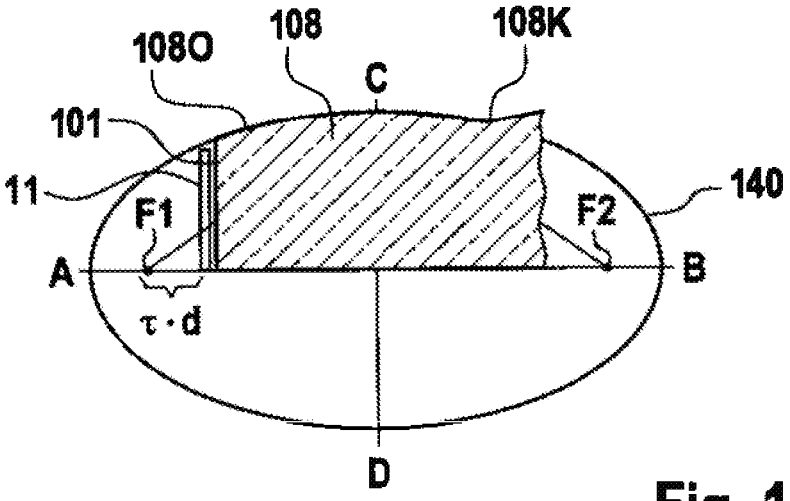
Figure 15:
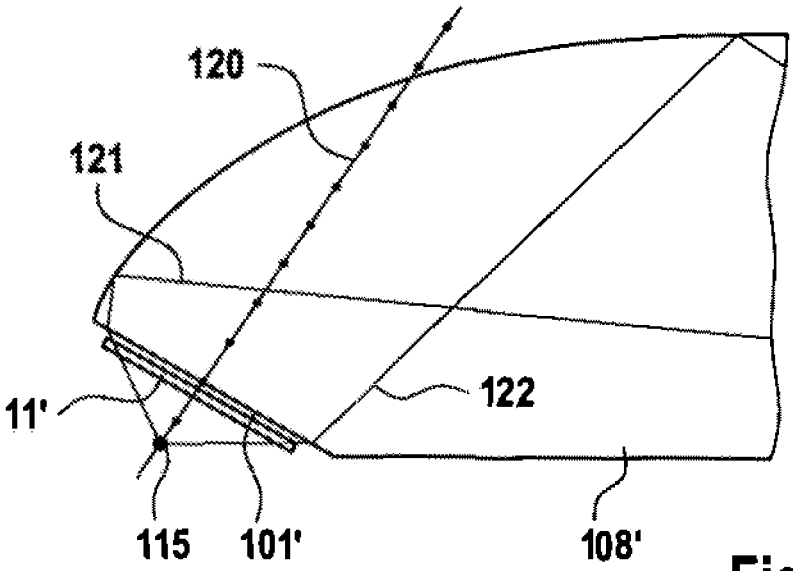
Figure 16:
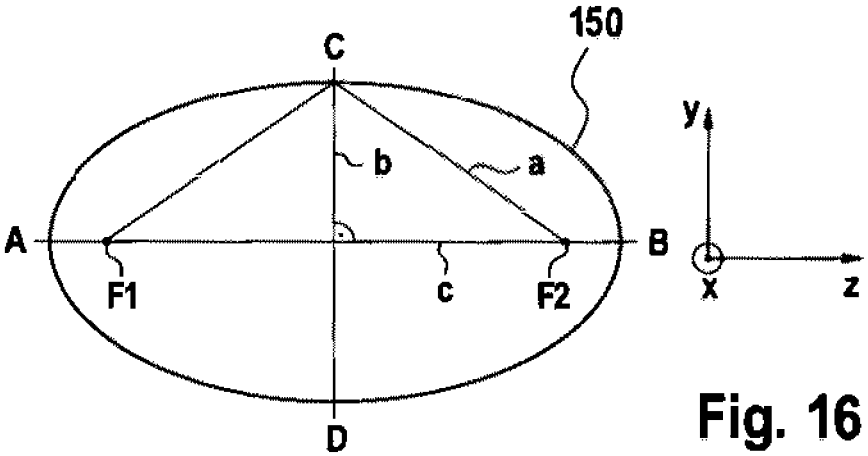
Figure 17:
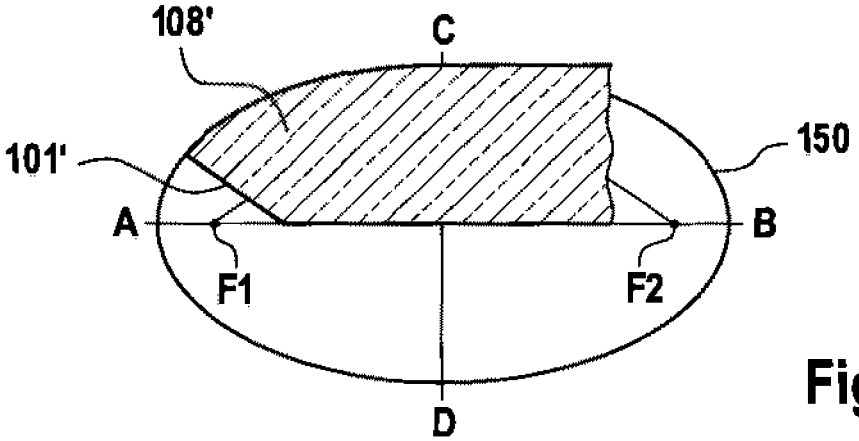

Further advantages and details result from the following description of exemplified embodiments. In the drawing:

FIG. 1 shows an exemplified embodiment of a motor vehicle,

FIG. 2 shows an exemplified embodiment of a motor vehicle headlight to be used in the motor vehicle according to FIG. 1 in a perspective front view, FIG. 3 shows a headlight lens of the motor vehicle headlight according to FIG. 2 in a perspective rear view, FIG. 4 shows a side view of the headlight lens according to FIG. 3, FIG. 5 shows a rear view of the headlight lens according to FIG. 3, FIG. 6 shows an enlarged detail of the rear view of the headlight lens according to FIG. 5, FIG. 7 shows an enlarged representation of the transition between the light tunnel and the light passage section of the headlight lens according to FIG. 3, FIG. 8 shows an exemplified embodiment of a Bézier curve describing a convex curvature of the bottom side of the light tunnel of the headlight lens according to FIG. 3, FIG. 9 shows an exemplified embodiment of a Bézier curve describing a concave curvature of the side walls of the light tunnel of the headlight lens according to FIG. 3, FIG. 10 shows an exemplified embodiment of an alternative function describing a concave curvature of the side walls of the light tunnel of the headlight lens according to FIG. 3, FIG. 11 shows an exemplified embodiment of an additional motor vehicle headlight to be used in the motor vehicle according to FIG. 1 in a perspective front view, FIG. 12 shows the illumination of a roadway by means of a motor vehicle headlight as a combination of the motor vehicle headlight according to FIG. 1 and the motor vehicle headlight according to FIG. 10, FIG. 13 shows an exemplified embodiment of an ellipsoid, FIG. 14 shows the ellipsoid according to FIG. 13 with a superimposed representation of a portion of the light tunnel shown in FIG. 3 as part of a headlight lens in a cross-sectional view, FIG. 15 shows a representation of details of an exemplified embodiment of an alternative design of a light tunnel for the headlight lens according to FIG. 3 or for the headlight lens according to FIG. 11 in a side view, FIG. 16 shows an exemplified embodiment of an ellipsoid, and FIG. 17 shows the ellipsoid according to FIG. 16 with a superimposed representation of a portion of the light tunnel shown in FIG. 15 in a cross-sectional view.

FIG. 1 shows an exemplified embodiment of a motor vehicle 1 having a motor vehicle headlight 10. FIG. 2 shows the motor vehicle headlight 10 in a plan view with a headlight lens 100, however without any housing, mountings and power supply. FIG. 3 shows the headlight lens 100 in a perspective rear view. FIG. 4 shows the headlight lens 100 in a side view, and FIG. 5 shows the headlight lens 100 in a rear view which is shown in FIG. 6 in an enlarged view. The headlight lens 100 comprises a press-molded monolithic body of inorganic glass, in particular glass comprising 0.2 to 2 weight percent of $Al_2O_3$,
0.1 to 1 weight percent of $Li_2O$,
0.3, in particular 0.4 to 1.5 weight percent of $Sb_2O_3$,
60 to 75 weight percent of $SiO_2$,
3 to 12 weight percent of $Na_2O$,
3 to 12 weight percent of $K_2O$ and
3 to 12 weight percent of CaO.

The press-molded monolithic body comprises a light tunnel 108 which comprises on the one side a light entry face 101 and passes over, on another side, via a bend 107 represented in an enlarged view in FIG. 7 and designed as a curved transition, into a light passage section 109 (of the press-molded monolithic body) which comprises a light exit face 102, wherein z is a coordinate in the direction of the optical axis of the light tunnel 108 and/or in the longitudinal direction of the light tunnel 108 and/or the optical axis of the headlight lens 100 and/or the light passage section 109 and/or the optical axis of the light exit face 102,
y is a coordinate in the vertical direction and/or an axis of rotation, and
x is a coordinate orthogonal to the y-direction and orthogonal to the z-direction and/or in the horizontal direction.

The headlight lens 100 is in particular designed such that light entering through the light entry face 101 into the headlight lens 100 and entering, in the region of the bend 107, from the light tunnel 108 into the light passage section, exits from the light exit face 102 essentially in parallel to the optical axis of the headlight lens 100. The bend 107 is formed by press-molding and is designed as continuously curved transition. The light passage section 109 (or the light exit face 102) images the bend 107 as a bright-dark-boundary, wherein by means of a light source 11 arranged on a support 11A and designed as an LED, light is irradiated or coupled into the light entry face 101 of the light tunnel 108 for implementing a low beam or for proportionally implementing a low beam. The light tunnel 108 has a transition region in which the surface 1080 limiting the light tunnel 108 to the top rises towards the light passage section 109 (and in which the surface limiting the light tunnel 108 to the bottom optionally extends approximately horizontally or in parallel to the optical axis of the headlight lens 100).

The light tunnel 108 comprises, at its surface 1080 limited to the top, a notch 108K extending transverse to the longitudinal direction of the light tunnel 108. The surface 1080 limiting the light tunnel 108 to the top comprises, in its front region, i.e., the side facing the light entry face 101 oriented (essentially) vertically or orthogonally to the optical axis (of the light tunnel 108, the light passage section 109 or the light exit face 102, respectively), a region 108E which is part of an ellipsoid. It is in particular provided for that the region 108E extends between the light entry face 101 and the notch 108K. It is in particular provided for that an edge of the notch 108K is part of the region 108E. The light source 11 is arranged (in the light path) between the two focusses/focal points of the ellipsoid.

The motor vehicle headlight 10 can be supplemented with further light sources as disclosed in WO 2012/072188 A1 and WO 2012/072192 A1. For example, by means of a light source that may be switched on for a selective implementation of sign light or high beam, corresponding to the light source 12 disclosed in WO 2012/072188 A1, light may be coupled or irradiated into a bottom side 108U of the light tunnel 108 and/or into the surface of the light passage section 109 facing the light tunnel 108.

The bottom side 108U (the surface 108U limiting the light tunnel 108 to the bottom) of the light tunnel 108 is convexly curved at least in the region of the bend 107 orthogonally to the longitudinal direction of the light tunnel 108. Here, the bottom side 108U of the light tunnel 108 is advantageously curved corresponding to a Bézier curve represented in FIG. 8. Here, the following designations apply (with x as a first coordinate and y as a second coordinate):

$P_1$ is the starting point of the Bézier curve with the coordinates 0.0,
$P_2$ is the end point of the Bézier curve with the coordinates $d_1,d_2$,
$P_3$ is the control point of the Bézier curve with the coordinates $s_1,s_2$, and
g is the weighting of the control point $P_3$.

In an advantageous embodiment, the following applies:

$0.3 \cdot d_1 \leq s_1 \leq 0.7 \cdot d_1$ and/or
$0.5\ mm \geq s_2 \geq 6\ mm$ and/or
$10\ mm \leq d_1 \leq 30\ mm$ and/or
$-3\ mm \leq d_2 \leq 3\ mm$ and/or
$-0.3\ mm \leq d_2 \leq 0.3\ mm$ and/or
$0.4 \leq g \leq 0.6$.

The lateral surfaces 108L and 108R of the light tunnel 108 form part of a funnel tapering in the direction towards the light entry face 101. Here, the lateral surfaces 108L and 108R of the light tunnel 108 are concavely curved. Below, the lateral surfaces 108L and 108R of the light tunnel 108 will also be referred to as side faces. Here is, in an advantageous embodiment, the side face 108R of the light tunnel 108 curved corresponding to a Bézier curve represented in FIG. 9. The curvature of the side face 108L is here optionally designed mirror-symmetrical with respect to the side face 108R. In FIG. 9, the following designations apply (with z as a first coordinate and x as a second coordinate):

$P_1$ is the starting point of the Bézier curve with the coordinates 0.0,
$P_2$ is the end point of the Bézier curve with the coordinates $d_1,d_2$,
$P_3$ is the control point of the Bezier curve with the coordinates $s_1,s_2$, and
g is the weighting of the control point $P_3$.

In an advantageous embodiment, the following applies:

$0.3 \cdot d_1 \leq s_1 \leq 0.7 \cdot d_1$ and/or
$0.4 \cdot d_2 \leq s_2 \leq 1.5 \cdot d_2$ and/or
$1.5 \leq d_1/d_2 \leq 10$ and/or
$0.3 \leq g \leq 0.7$.

FIG. 10 shows an alternative embodiment of the curved side faces 108L and 108R of the light tunnel 108, defined by the function Γ taking the curved side face 108L as an example. The starting point of Γ is $r_{START}$(x>0, y=0, z=0, s=0), and the end point of Γ is $r_{END} \neq 0$, y=0, z>0, s=L). The radius of curvature R of Γ is a function of the arc length s:

$$R=R(s)$$

with $$20\ \text{mm} \leq R(s) \leq 200\ \text{mm}$$

at an overall arc length L of $$10\ \text{mm} \leq L \leq 40\ \text{mm}$$

For the curvature K=1/R, the following applies (strictly concavely): K must not change the mathematical sign (and not become zero).

In FIG. 10, $P_{OPT}$ designates a parallel line to the optical axis of the headlight lens 100 or to the z-coordinate. $T_{start}$ designates the starting tangent of the arc length s which is inclined with respect to the parallel line to the optical axis of the headlight lens 100 or to the z-coordinate about an angle δ with $$0° < \delta \leq 15°$$

(positive δ means "left" of the optical axis).

FIG. 11 shows—in a perspective front view—an exemplified embodiment of a motor vehicle headlight 20 with a headlight lens 200, however without any housing, mountings and power supply. The headlight lens 200 comprises, just as the headlight lens 100, a (press-molded) monolithic body of inorganic glass, in particular glass comprising 0.2 to 2 weight percent of $Al_2O_3$,
0.1 to 1 weight percent of $Li_2O$,
0.3, in particular 0.4 to 1.5 weight percent of $Sb_2O_3$,
60 to 75 weight percent of $SiO_2$,
3 to 12 weight percent of $Na_2O$,
3 to 12 weight percent of $K_2O$ and
3 to 12 weight percent of CaO.

The (press-molded) monolithic body comprises a light tunnel 208 which comprises on the one side a light entry face corresponding to the light entry face 101, and passes over, on another side, via a bend 207 corresponding to the bend 207, into a light passage section 209 (of the monolithic body) comprising a light exit face 202.

The headlight lens 200 is in particular designed such that light entering through the light entry face into the headlight lens 200 and entering, in the region of the bend 207, from the light tunnel 208 into the light passage section, exits from the light exit face 202 essentially parallel to the optical axis of the headlight lens 200. The bend 207 is, just as the bend 107 (formed by press-molding and) designed as (continuously) curved transition. The light passage section 209 images the bend as a bright-dark-boundary, wherein light is, by means of a light source 21 arranged on a support 21A and designed as an LED, for implementing a low beam or for proportionally implementing a low beam, irradiated or coupled into the light entry face 201 of the light tunnel 208. In the present exemplified embodiment, it is provided for that the motor vehicle headlight 10 and the motor vehicle headlight 20 complement each other to form a low beam. That means, the motor vehicle headlight 10 and the motor vehicle headlight 20 together form a motor vehicle headlight for implementing a low beam for the projection of a bright-dark-boundary onto a roadway, represented in FIG. 12.

The upper part of the light tunnel 108 depicted in FIG. 3, FIG. 4, FIG. 5 and FIG. 6 (and optionally the upper part of the light tunnel 208 depicted in FIG. 11) is designed as an ellipsoid 140 as it is represented in FIG. 13. To illustrate this embodiment, in FIG. 14, a part of the cross-section of the light tunnel 108 is superimposed on the representation of the ellipsoid 140. For the ellipsoid 140 represented in FIG. 13 and FIG. 14, the following applies:

Here (see above)
z is a coordinate in the direction of the optical axis of the light tunnel (A→B),
x is a coordinate orthogonal to the direction of the optical axis of the light tunnel, and
y is a coordinate orthogonal to the direction of the optical axis of the light tunnel and to the x-direction (D→C).

a, b and thereby c are selected such that all light beams passing through the focus F1 are collected again in the focus F2 after having been mirrored in the ellipsoid's surface. The distance of the light source 11 from the focus F1 is τ·d, wherein d is the distance of the focus F1 from the focus F2, and wherein τ is greater than 0 and smaller than or equal to 0.1. In an advantageous embodiment of the invention, τ is greater than or equal to 0.025 and smaller than or equal to 0.1. In a further advantageous embodiment of the invention, τ is greater than or equal to 0.05 and smaller than or equal to 0.1.

FIG. 15 shows a representation of a side view of a light tunnel 108' in sections for an alternative embodiment of the light tunnel 108 or the light tunnel 208, respectively. Reference numeral 101' designates the light entry face of the light tunnel 108', and reference numeral 11' designates a light source analogue to the light source 11 or 21, respectively. The upper portion of the part of the light tunnel 108' depicted in FIG. 15 is designed as an ellipsoid 150 as it is represented in FIG. 16. The ellipsoid 150 may correspond to the ellipsoid 140. However, it may also be provided for that the ellipsoid 150 and the ellipsoid 140 differ from each other. To illustrate this embodiment, a part of the cross-section of the light tunnel 108' is superimposed on the representation of the ellipsoid 150 in FIG. 17. For the ellipsoid 150 represented in FIG. 16 and FIG. 17, the following applies:

Here (see above)
z is a coordinate in the direction of the optical axis of the light tunnel (A→B),
x is a coordinate orthogonal to the direction of the optical axis of the light tunnel, and
y is a coordinate orthogonal to the direction of the optical axis of the light tunnel and to the x-direction (D→C).

a, b and thereby c are selected such that all light beams passing through the focus F1 are collected again in the focus F2 after having been mirrored in the ellipsoid's surface. The course of the light beams of the light of the light source 11' coupled or irradiated into the light entry face 101 is illustrated by the light beams 121 and 122 represented in FIG. 15. Reference numeral 120 in FIG. 15 designates the orthogonal of the light entry face 101'. The common point of intersection of the orthogonal 120 of the light entry face 101' with the light beams 121 and 122 is designated with reference numeral 115. The position of this point of intersection 115 corresponds to the focus F1 in FIG. 16 and FIG. 17. The light source (light path) is arranged between the focus F1 and the focus F2.

The elements in the FIGS. 8, 9, 10, 13, 14, 15, 16, and 17 are depicted taking into consideration simplicity and clarity, and they are not necessarily drawn to scale. For example, in FIGS. 8, 9, 10, 13, 14, 15, 16, and 17, the dimensions of some elements are represented in an exaggerated manner with respect to other elements to improve the understanding of the exemplified embodiments of the present invention. If coordinate systems are depicted in the Figures, their origin lies in the point where the optical axis of the headlight lens passes through the light entry face, even if these coordinate systems are shifted for a better overview so that their represented origin does not correspond to the actual origin.

The invention claimed is:

1. A vehicle headlight comprising a headlight lens and a light source, wherein the headlight lens comprises a body of a transparent material, the body comprising:

at least one light tunnel with at least one light entry face, a left surface, a right surface, a top surface, and a bottom surface; and a light passage section with at least one optically effective light exit face, wherein the light tunnel passes over, via a bend, into the light passage section for imaging the bend as a bright-dark-boundary by means of light of the light source irradiating into the light entry face;

wherein the bottom surface of the light tunnel is at least partially convexly curved in the region of the bend;

and wherein at least one surface of the group consisting of the left surface and the right surface is curved concavely corresponding to a first Bezier curve.

2. The vehicle headlight of claim 1, wherein a convexly curved part of the surface at the bottom of the light tunnel is curved corresponding to a second Bézier curve.

3. The vehicle headlight of claim 1, wherein a convexly curved part of the bottom surface of the light tunnel is curved corresponding to a second Bézier curve, wherein $0.3 \cdot d_1 \leq s_1 \leq 0.7 \cdot d_1$, $0.5\ mm \leq s_2 \leq 6\ mm$, $10\ mm \leq d_1 \leq 30\ mm$, $-3\ mm \leq d_2 \leq 3\ mm$, $0.3\ mm \leq d_2 \leq 0.3\ mm$, and $0.4 \leq g \leq 0.6$, wherein the starting point of the Bézier curve has the coordinates 0.0, the end point of the Bézier curve has the coordinates $d_1,d_2$, a one control point of the Bézier curve has the coordinates $s_1,s_2$, and the control point of the Bézier curve has the weighting g.

4. The vehicle headlight of claim 1, wherein with respect to the first Bézier curve, wherein $0.3 \cdot d_1 \leq s_1 \leq 0.7 \cdot d_1$, $0.4 \cdot d_2 \leq s_2 \leq 1.5 \cdot d_2$, $1.5 \leq d_1/d_2 \leq 10$, and $0.3 \leq g \leq 0.7$ wherein the starting point of the Bezier curve has the coordinates 0.0, the end point of the Bezier curve has the coordinates $d_1,d_2$, a control point of the Bezier curve has the coordinates $s_1,s_2$, and the control point of the Bezier curve has the weighting g.

5. A vehicle headlight comprising a headlight lens and a light source, wherein the headlight lens comprises a body of a transparent material, the body comprising:

at least one light tunnel with at least one light entry face and a bottom surface, wherein the light tunnel comprises a region on its surface limiting the light tunnel to the top which essentially corresponds to a part of the surface of an ellipsoid; and a light passage section with at least one optically effective light exit face, wherein the light tunnel passes over, via a bend, into the light passage section for imaging the bend as a bright-dark-boundary by means of light of the light source irradiating into the light entry face;

wherein the light tunnel comprises a left surface and a right surface, wherein at least one surface of the group consisting of the left surface and the right surface is curved concavely corresponding to a first Bézier curve.

6. The vehicle headlight of claim 5, the ellipsoid comprising a first focal point and a second focal point, wherein the light source is arranged between the first focal point and the second focal point.

7. The vehicle headlight of claim 6, wherein a distance of the light source from the first focal point is $\tau \cdot d$ in a direction orthogonal regarding the light entry face, wherein d is the distance of the first focal point from the second focal point, and wherein $\tau$ is greater 0.025 and not greater than 0.1.

8. The vehicle headlight of claim 6, wherein a distance of the light source from the first focal point is $\tau \cdot d$ in a direction of a straight line through the first focal point and the second focal point, wherein d is the distance of the first focal point from the second focal point, and wherein $\tau$ is greater 0.025 and not greater than 0.1.

9. The vehicle headlight of claim 6, wherein the bottom surface of the light tunnel is at least partially convexly curved in the region of the bend, wherein a convexly curved part of the surface at the bottom of the light tunnel is curved corresponding to a second Bézier curve.

10. The vehicle headlight of claim 9, wherein $0.3 \cdot d_1 \leq s_1 \leq 0.7 \cdot d_1$, $0.5\ mm \leq s_2 \leq 6\ mm$, $10\ mm \leq d_1 \leq 30\ mm$, $-3\ mm \leq d_2 < 3\ mm$, $0.3\ mm \leq d_2 \leq 0.3\ mm$, and $0.4 \leq g \leq 0.6$, wherein the starting point of the Bezier curve has the coordinates 0.0, the end point of the Bezier curve has the coordinates $d_1,d_2$, a control point of the Bezier curve has the coordinates $s_1,s_2$, and the control point of the Bezier curve has the weighting g.

11. The vehicle headlight of claim 5, wherein with respect to the second Bézier curve, $0.3 \cdot d_1 \leq s_1 \leq 0.7 \cdot d_1$, $0.4 \cdot d_2 \leq s_2 \leq 1.5 \cdot d_2$, $1.5 \leq d_1/d_2 \leq 10$, and $0.3 \leq g \leq 0.7$ wherein the starting point of the Bezier curve has the coordinates 0.0, the end point of the Bezier curve has the coordinates $d_1,d_2$, a control point of the Bezier curve has the coordinates $s_1,s_2$, and the control point of the Bezier curve has the weighting g.

12. A vehicle headlight comprising a headlight lens and a light source, wherein the headlight lens comprises a body of a transparent material, the body comprising:

at least one light tunnel with at least one light entry face and a bottom surface; and a light passage section with at least one cylindrical light exit face, wherein the light tunnel passes over, via a bend, into the light passage section for imaging the bend as a bright-dark-boundary by means of light of the light source irradiating into the light entry face, wherein the light tunnel comprises a left surface and a right surface, wherein at least one surface of the group consisting of the left surface and the right surface is curved concavely corresponding to a first Bézier curve.

13. The vehicle headlight of claim 12, wherein the light exit face extends, in the horizontal direction, by more than 1.5 times its extension in the vertical direction.

14. The vehicle headlight of claim 12, wherein the light tunnel comprises a region on its surface limiting the light tunnel to the top which essentially corresponds to a part of the surface of an ellipsoid.

15. The vehicle headlight of claim 14, the ellipsoid comprising a first focal point and a second focal point, wherein the light source is arranged between the first focal point and the second focal point.

16. The vehicle headlight of claim 15, wherein a distance of the light source from the first focal point is $\tau \cdot d$ in a direction orthogonal regarding the light entry face, wherein d is the distance of the first focal point from the second focal point, and wherein $\tau$ is greater 0.025 and not greater than 0.1.

17. The vehicle headlight of claim 15, wherein a distance of the light source from the first focal point is $\tau \cdot d$ in a direction of a straight line through the first focal point and the second focal point, wherein d is the distance of the first focal point from the second focal point, and wherein $\tau$ is greater 0.025 and not greater than 0.1.

18. The vehicle headlight of claim 12, wherein the bottom surface of the light tunnel is at least partially convexly curved in the region of the bend.

19. The vehicle headlight of claim 18, wherein the convexly curved surface at the bottom of the light tunnel is curved corresponding to a second Bezier curve, wherein $0.3 \cdot d_1 \leq s_1 \leq 0.7 \cdot d_1$, $0.5\ \text{mm} \leq s_2 \leq 6\ \text{mm}$, $10\ \text{mm} \leq d_1 \leq 30\ \text{mm}$, $-3\ \text{mm} \leq d_2 \leq 3\ \text{mm}$, $0.3\ \text{mm} \leq d_2 \leq 0.3\ \text{mm}$, and $0.4 \leq g \leq 0.6$, wherein the starting point of the Bezier curve has the coordinates 0.0, the end point of the Bezier curve has the coordinates $d_1, d_2$, a control point of the Bezier curve has the coordinates $s_1, s_2$, and the control point of the Bezier curve has the weighting g.

20. The vehicle headlight of claim 12, wherein the light tunnel comprises a left surface and a right surface, wherein at least one surface of the group consisting of the left surface and the right surface is curved concavely.

21. The vehicle headlight of claim 20, wherein the light tunnel comprises a region on its surface limiting the light tunnel to the top which essentially corresponds to a part of the surface of an ellipsoid.

22. The vehicle headlight of claim 21, the ellipsoid comprising a first focal point and a second focal point, wherein the light source is arranged between the first focal point and the second focal point.

23. The vehicle headlight of claim 22, wherein a distance of the light source from the first focal point is $\tau \cdot d$ in a direction orthogonal regarding the light entry face, wherein d is the distance of the first focal point from the second focal point, and wherein $\tau$ is greater 0.025 and not greater than 0.1.

24. The vehicle headlight of claim 22, wherein a distance of the light source from the first focal point is $\tau \cdot d$ in a direction of a straight line through the first focal point and the second focal point, wherein d is the distance of the first focal point from the second focal point, and wherein $\tau$ is greater 0.025 and not greater than 0.1.

25. A vehicle headlight comprising a headlight lens and a light source, wherein the headlight lens comprises a body of a transparent material, the body comprising:

at least one light tunnel with at least one light entry face, a left surface, a right surface and a bottom surface; and a light passage section with at least one light exit face, wherein the light tunnel passes over, via a bend, into the light passage section for imaging the bend as a bright-dark-boundary by means of light of the light source irradiating into the light entry face;

wherein the bottom surface of the light tunnel is at least partially convexly curved in the region of the bend;

wherein at least one surface of the group consisting of the left surface and the right surface is curved concavely corresponding to a Bézier curve.

26. The vehicle headlight of claim 25, wherein $0.3 \cdot d_1 \leq s_1 \leq 0.7 \cdot d_1$, $0.4 \cdot d_2 \leq s_2 \leq 1.5 \cdot d_2$, $1.5 \leq d_1/d_2 \leq 10$, and $0.3 \leq g \leq 0.7$, wherein the starting point of the Bézier curve has the coordinates 0.0, the end point of the Bézier curve has the coordinates $d_1, d_2$, a control point of the Bézier curve has the coordinates $s_1, s_2$, and the control point of the Bézier curve has the weighting g.

27. A vehicle headlight comprising a headlight lens and a light source, wherein the headlight lens comprises a body of a transparent material, the body comprising:

at least one light tunnel with at least one light entry face, a top surface and a bottom surface; and a light passage section with at least one optically effective light exit face, wherein the light tunnel passes over, via a bend, into the light passage section for imaging the bend as a bright-dark-boundary by means of light of the light source irradiating into the light entry face;

wherein the bottom surface of the light tunnel is at least partially convexly curved corresponding to a Bézier curve in the region of the bend.

28. The vehicle headlight of claim 27, wherein $0.3 \cdot d_1 \leq s_1 \leq 0.7 \cdot d_1$, $0.4\ 0.5\ \text{mm} \leq s_2 \leq 6\ \text{mm}$, $10\ \text{mm} \leq d_1 \leq 30\ \text{mm}$, $-3\ \text{mm} \leq d_2 \leq 3\ \text{mm}$, $-0.3\ \text{mm} \leq d_2 \leq 0.3\ \text{mm}$, and $0.4 \leq g \leq 0.6$, wherein the starting point of the Bezier curve has the coordinates 0.0, the end point of the Bezier curve has the coordinates $d_1, d_2$, a control point of the Bezier curve has the coordinates $s_1, s_2$, and the control point of the Bezier curve has the weighting g.

29. The vehicle headlight of claim 1, wherein the bottom surface of the light tunnel is at least partially convexly curved in the region of the bend.

30. The vehicle headlight of claim 29, wherein the top surface of the light tunnel is at least partially convexly curved.

* * * * *